United States Patent [19]

Edamura et al.

[11] Patent Number: 4,543,136

[45] Date of Patent: Sep. 24, 1985

[54] WATER-IN-OIL EMULSION EXPLOSIVE COMPOSITION

[75] Inventors: Kohji Edamura; Akio Torii; Katsuhide Hattori; Hiroshi Sakai, all of Chita, Japan

[73] Assignee: Nippon Oil and Fats Co., Ltd., Tokyo, Japan

[21] Appl. No.: 642,265

[22] Filed: Aug. 20, 1984

[30] Foreign Application Priority Data

Sep. 1, 1983 [JP] Japan ..... 58-158960

[51] Int. Cl.[4] ..... C06B 45/02

[52] U.S. Cl. ..... 149/21; 149/2; 149/36; 149/38; 149/39; 149/40; 149/41; 149/42; 149/43; 149/46; 149/47; 149/55; 149/56; 149/62; 149/69; 149/76; 149/78; 149/80; 149/88; 149/92; 149/105; 149/110

[58] Field of Search ..... 149/2, 21, 36, 38, 39, 149/40, 41, 42, 43, 46, 47, 55, 56, 62, 69, 76, 78, 80, 88, 92, 105, 110

[56] References Cited

U.S. PATENT DOCUMENTS 4,315,784 2/1982 Hattori et al. ..... 149/60
4,326,900 4/1982 Hattori et al. ..... 149/2

*Primary Examiner*—Stephen J. Lechert, Jr.
*Attorney, Agent, or Firm*—Parkhurst & Oliff

[57] ABSTRACT

A gas-retaining agent having a particle size of 177–3,000 μm is effective for improving the safety of water-in-oil emulsion explosive compositions against methane and coal dust and for improving the sympathetic detonability of the explosive compositions without deteriorating their strength.

4 Claims, No Drawings

WATER-IN-OIL EMULSION EXPLOSIVE COMPOSITION

BACKGROUND OF THE INVENTION (1) Field of the Invention:

The present invention relates to a water-in-oil emulsion explosive composition, and more particularly relates to a water-in-oil emulsion explosive composition containing a gas-retaining agent, which has a specifically limited particle size, and having a low detonation velocity and an excellent sympathetic detonation performance without noticeable lowering of the strength.

(2) Description of the Prior Art:

Various investigations have been recently made with respect to water-in-oil emulsion explosive (hereinafter, abbreviated as W/O explosive). For Example, as disclosed in U.S. Pat. No. 3,161,551 and No. 3,447,978, the W/O explosive has an emulsified structure consisting of a continuous phase which consists of carbonaceous fuel component, and a disperse phase, which consists of an aqueous solution of inorganic oxidizer salt, such as ammonium nitrate or the like, and is entirely different in the structure from hitherto been known oil-in-water slurry explosive (hereinafter, abbreviated as O/W explosive).

That is, O/W explosive has an oil-in-water structure, wherein an aqueous solution of oxidizer salt, a sensitizer and the like are dispersed in the form of a gel together with a gelatinizer as described, for example, in Makoto Kimura, "Slurry Explosive, Performance and Use Method", Sankaido (1975). On the contrary, W/O emulsive has a water-in-oil microfine structure, wherein microfine droplets consisting of an aqueous solution of inorganic oxidizer salt and having a particle size of 10 μm–0.1 μm are covered with a very thin film of oil consisting of a carbonaceous fuel component and a surfactant as described, for example, in Kogyo Kayaku Kyokei-Shi, 43 (No. 5), 285–294 (1982).

W/O emulsion is remarkably different from O/W emulsion in the performance and composition due to the above described difference in the structure. That is, O/W explosive requires to contain a sensitizer, such as aluminum (U.S. Pat. No. 3,121,036), monomethylamine nitrate (U.S. Pat. No. 3,431,155 and No. 3,471,346) or the like, and is relatively low in the detonation velocity. On the contrary, W/O explosive is good in the contact efficiency of the carbonaceous fuel component with the inorganic oxidizer salt, and hence the W/O explosive has excellent properties. For examples, the W/O explosive is high in the detonation velocity, has cap-sensitivity in itself without containing sensitizer, is good in after-detonation fume, and can be changed widely in its consistency.

However, in order to maintain cap-sensitivity, propagation property of detonation, and sympathetic detonation property in a W/O explosive, the explosive must contain bubbles. As the gas-retaining agent, hollow microspheres having a small particle size are generally used. For example, U.S. Pat. No. 4,110,134 discloses the use of glass microballoons and Saran resin microballoons which form rigid independent bubbles and have a particle size of 10–175 μm; Japanese Patent Laid-Open Application No. 84,395/81 discloses the use of shirasu (shirasu is a kind of volcanic ash); and a U.S. patent application Ser. No. 627,781 filed July 5, 1984 discloses the use of resin microballoons. All of these prior arts use hollow microspheres having a particle size of not larger than 175 μm. Alternatively, U.S. Pat. No. 4,008,108 discloses the use, in place of the use of these gas-retaining agents, of simple bubbles mechanically flown into an explosive or simple bubbles formed from a foaming agent and the like. However, the simple bubbles as such as cannot be contained in the resulting W/O explosive in an amount more than a certain amount, are difficult to be contained in the W/O explosive for a long time, and leak from the explosive with the lapse of time, and hence the explosive loses its cap sensitivity and deteriorates in a short time, and is not advantageous for practical use. Accordingly, in order to maintain the cap sensitivity and sympathetic detonability and to obtain the detonation liability in a W/O explosive, there have hitherto been predominantly used hollow microspheres formed of a relatively hard substance and having a small particle size and being capable of forming independent bubbles and retaining the bubbles for a long time.

However, the above described W/O explosive is generally higher in the detonation velocity than O/W explosive, and the production of W/O explosive having a low detonation velocity has been difficult. For example, in order to produce a W/O explosive having a low detonation velocity, a W/O explosive having a low specific gravity or an extremely low strength is produced. However, in order to lower the specific gravity, even when a large amount of the above described hollow microspheres having a small particle size are used so as to contain 40% by volume, based on the volume of the resulting W/O explosive, of bubbles in the explosive, a W/O explosive having a detonation velocity under unconfined state of not higher than 3,000 m/sec cannot be obtained. Moreover, when such large amount of gas-retaining agent is used, the sympathetic detonability and detonation reliability of the resulting W/O explosive are greatly decreased, and the explosive cannot be practically used. Alternatively, in order to decrease the strength, a large amount of inactive substance of flame coolant, such as sodium chloride, water or the like, is used, the obtained results are the same as the above described results in the use of a large amount of microspheres, that is, due to the presence of a large amount of inactive substance, a W/O explosive having a detonation velocity of not higher than 3,000 m/sec under unconfined state cannot be obtained, and further the resulting W/O explosive deteriorates rapidly with the lapse of time, is poor in the sympathetic detonability, has a broken fine structure and has no cap-sensitivity.

When ordinary explosive is used in a place, wherein combustible gases, such as methane and the like, or combustible dusts, such as coal dust and the like, are present, there is a risk of gas explosion or dust explosion. Such operation site, for example, coal mine or like is in duty bound to use an explosive having a safety higher than a given safety standard. In order to produce an explosive having a high safety against methane, coal dust and the like, it is indispensable to decrease the strength of explosive and further to decrease the detonation velocity. Particularly, in a W/O explosive having a relatively high detonation velocity, in order to obtain the same safety as that of W/O explosive, the strength of the W/O explosive must be extremely lowered (for example, Japanese Patent Laid-Open Application No. 155,091/81). However, a W/O explosive having an extremely low strength is poor in the detonation liability, sympathetic detonability and storage stability, and cannot be practically used. Moreover, the use of an explosive having a low strength is poor in the mining effect and increases the number of blasting times, resulting in an increased danger.

The inventors have variously studied in order to produce a W/O explosive having a low detonation velocity, a high safety and an excellent sympathetic detonability without decreasing extremely its strength, and surprisingly found out that the use of a specifically limited gas-retaining agent can produce effectively a W/O explosive composition having a low detonation velocity and an excellent sympathetic detonability, and have reached the present invention.

SUMMARY OF THE INVENTION

The object of the present invention is to provide a cap-sensitive W/O explosive having a low detonation velocity and an excellent sympathetic detonability.

The feature of the present invention is the provision of a water-in-oil emulsion explosive composition comprising a continuous phase consisting of a carbonaceous fuel component; a disperse phase consisting of an aqueous solution of inorganic oxidizer salt; an emulsifier and a gas-retaining agent, the improvement comprising the gas-retaining agent having a particle size of 177–3,000 μm.

DESCRIPTION OF THE PREFERRED EMBODIMENT

As the carbonaceous fuel component, which forms a continuous phase in the water-in-oil emulsion explosive composition of the present invention, there can be used any of hydrocarbon series substances of fuel oil and/or wax, which have been used for forming a continuous phase in conventional W/O explosives. The fuel oil includes, hydrocarbons, for example, paraffinic hydrocarbon, olefinic hydrocarbon, naphthenic hydrocarbon, other saturated or unsaturated hydrocarbon, petroleum, purified mineral oil, lubricant, liquid paraffin and the like; and hydrocarbon derivatives, such as nitrohydrocarbon and the like. The wax includes unpurified microcrystalline wax, purified microcrystalline wax, paraffin wax and the like, which are derived from petroleum; mineral waxes, such as montan wax, ozokerite and the like; animal waxes, such as whale wax and the like; and insect waxes, such as beeswax and the like. These carbonaceous fuel components are used alone or in admixture. The compounding amount of these carbonaceous fuel components is generally 1–10% by weight (hereinafter, % means % by weight based on the total amount of the resulting explosive composition unless otherwise indicated).

As the inorganic oxidizer salt for an aqueous solution of inorganic oxidizer salt, which solution forms the disperse phase in the W/O explosive of the present invention, use is made of, for example, ammonium nitrate; nitrates of alkali metal or alkaline earth metal, such as sodium nitrate, calcium nitrate and the like; chlorates or perchlorates of ammonia, alkali metal or alkaline earth metal, such as sodium chlorate, ammonium perchlorate, sodium perchlorate and the like. These inorganic oxidizer salts are used alone or in admixture of at least two members. Further, these inorganic oxidizer salts can be used in combination with other inorganic oxidizer salt. The compounding amount of the inorganic oxidizer salt is generally 5–90%, preferably 40–85%. The inorganic oxidizer salt is used in the form of an aqueous solution. In this case, the compounding amount of water is generally 3–30%, preferably 5–25%.

In general, ordinary W/O explosives inclusive of the W/O explosive of the present invention use an emulsifier in order to obtain an emulsified structure. Therefore, in the present invention, any of emulsifiers, which have hitherto been used in the production of W/O explosive can be used in order to attain effectively the object of the present invention. As the emulsifier, use is made of, for example, fatty acid esters of sorbitan, such as sorbitan monolaurate, sorbitan monooleate, sorbitan monopalmitate, sorbitan monostearate, sorbitan sesquioleate, sorbitan dioleate, sorbitan trioleate and the like; mono- or di-glycerides of fatty acid, such as stearic acid monoglyceride and the like; fatty acid esters of polyoxyethylenesorbitan; oxazoline derivatives; imidazoline derivatives; phosphoric acid esters; alkali or alkaline earth metal salts of fatty acid; primary, secondary or tertiary amine; and the like. These emulsifiers are used alone or in admixture. The compounding amount of the emulsifier is 0.1–10%, preferably 1–5%.

The gas-retaining agent having a specifically limited particle size according to the present invention includes all of the hollow microspheres, which are formed of commonly known various materials and have a particle size of 177–3,000 μm in at least 30% by volume of the hollow microspheres. The term "particle size" herein used means a length of the longest portion constituting physically the hollow microspheres. As the hollow microspheres, use is made of inorganic hollow microspheres obtained from, for example, glass, alumina, shale, shirasu (shirasu is a kind of volcanic ash), silica sand, volcanic rock, sodium silicate, borax, perlite, obsidian and the like; carbonaceous hollow microspheres obtained from pitch, coal, carbon and the like; and synthetic resin hollow microspheres obtained from phenolic resin, polyvinylidene chloride resin, polystyrene resin, epoxy resin, polyethylene resin, polypropylene resin, urea resin and the like, or from a mixture of these resins with other various resins, or from a copolymer resin of the monomer of the above described resin and other monomer.

In general, these gas-retaining agents consist of a mixture of gas-retaining agents having various particle sizes. In the present invention, it is necessary to use a gas-retaining agent having a particle size of 177–3,000 μm in at least 30% by volume preferably at least 50% by volume of the agent. A gas-retaining agent having a particle size smaller than 177 μm is not effective for lowering the detonation velocity, and reversely a gas-retaining agent having a particle size larger than 3,000 μm is poor in the cap-sensitivity. A gas-retaining agent having a particle size of 300–2,500 μm in at least 30% by volume is effective, and a gas-retaining agent having a particle size of 600–2,000 μm in at least 50% by volume is particularly effective, for lowering the detonation velocity.

In the present invention, any of gas-retaining agents containing at least 30% by volume of hollow microspheres having a particle size within the range of 177–3,000 μm can be used independently of their material and shape, and any of globular, cylindrical, polyhedral, box-shaped and amorphous gas-retaining agents can lower the detonation velocity and improve the sympathetic detonability of the resulting W/O explosive. However, shirasu balloons, glass balloons, resin balloons and the like are advantageously used because they can be easily available in the market. These gas-retaining agents are used alone or in admixture. The use amount of the gas-retaining agent varies depending upon the volume of bubbles, which occupies in the agent. In general, the use amount of the gas-retaining agent is determined such that bubbles contained in the agent occupy 1-50% by volume of the resulting W/O explosive. When the volume occupied by bubbles in a W/O explosive is less than 1% by volume, the explosive is poor in the cap-sensitivity. While, when the volume occupied by bubbles in a W/O explosive is more than 50% by volume, the explosive is poor in the strength and detonation liability. The use amount of gas-retaining agent is generally controlled such that bubbles occupy preferably 3-40% by volume, more preferably 5-30% by volume, of the volume of the resulting W/O explosive.

In the present invention, the use of sensitizer is effective for improving the detonation liability and low temperature detonability of the resulting W/O explosive. It is possible to use any of commonly known sensitizers, such as aluminum powder, monomethylamine nitrate, hydrazine nitrate, glycinonitrile nitrate, ethylenediamine dinitrate, ethanolamine nitrate, urea nitrate, guanidine nitrate, trinitrotoluene and the like. The compounding amount of the sensitizer is 0-40%, preferably 0.5-30%, particularly preferably 1-20%. A W/O explosive containing more than 40% of a sensitizer is dangerous in handling and is difficult in securing its safety against methane and coal dust. Among the above described sensitizer, monomethylamine nitrate, hydrazine nitrate and ethylenediamine dinitrate are preferably used, and hydrazine nitrate is particularly preferably used because of its high effect for promoting the dissolving of inorganic oxidizer salt in water.

Further, in the present invention, the use of a commonly known flame coolant of a halogenide, such as sodium chloride, potassium chloride, seaweeds or the like, is an effective means for improving the safety of the resulting W/O explosive against methane and coal dust. In general, the flame coolant is used in an amount of 0-50%, preferably 1-40%.

The water-in-oil emulsion explosive composition of the present invention is produced, for example, in the following manner.

Ammonium nitrate or a mixture of ammonium nitrate with other inorganic oxidizer salt, a sensitizer and the like is dissolved in water at about 60°-100° C. to produce an aqueous solution of the oxidizer salts. A carbonaceous fuel component is melted together with an emulsifier (generally at 70°-90° C.) to obtain a combustible material mixture. Then, the above obtained aqueous solution of the oxidizer salts is mixed with the combustible material mixture at a temperature of 60°-90° C. under agitation at a rate of 600-2,000 rpm, to obtain a water-in-oil emulsion.

Then, the water-in-oil emulsion is mixed with a gas-retaining agent according to the present invention and, occasionally, a flame coolant in a vertical type kneader while agitating the mass in the kneader at a rate of about 30 rpm, to obtain a water-in-oil emulsion explosive (W/O explosive) composition. In the above described procedure, the sensitizer or a part of the inorganic oxidizer salt is not dissolved in water, but may be directly added to the emulsion and kneaded together with the emulsion, whereby a W/O explosive composition may be produced.

The following examples are given for the purpose of illustration of this invention and are not intended as limitations thereof. In the examples, "parts" and "%" means by weight.

EXAMPLE 1

A W/O explosive having a composition shown in the following Table 1 was produced in the following manner.

To 12.0 parts of water were added 73.3 parts of ammonium nitrate and 4.2 parts of sodium chlorate, and the resulting mixture was heated to 90° C. to dissolve completely the oxidizer salts and to obtain an aqueous solution of the oxidizer salts. A mixture of 3.0 parts of crude paraffin as a carbonaceous fuel component and 1.5 parts of sorbitan oleate as an emulsifier was melted at 90° C. to produce a combustible material mixture. To the combustible material mixture was gradually added 88.5 parts of the above described aqueous solution of the oxidizer salts while agitating the resulting mixture at a rate of 650 rpm under heating at 90° C. After completion of the addition, the resulting mixture was further agitated at a rate of 1,800 rpm for 3 minutes to obtain 94 parts of a W/O emulsion. Then, 94 parts of the resulting W/O emulsion was kneaded by hand in a mortar together with 5.0 parts of silica balloons having a particle size of 210-1,190 μm (obtained by sieving Silica Balloon NL sold by kushiro Sekitan Kanryu Co.) and 1.0 part of glass hollow capillaries having a length of 1,500-3,000 μm to produce a W/O explosive composition. The resulting W/O explosive composition was weighed 100 g by 100 g, and each mass was packed in a cylindrical viscose paper tube having a diameter of 30 mm to obtain a W/O explosive cartridge.

The performance and safety of the resulting W/O explosive composition were examined by the following test with the use of the cartridge.

The explosion performance of the explosive composition was evaluated by the detonation velocity test under unconfined state and by the gap test on sand. The strength of the explosive composition was evaluated by the ballistic mortar test (abbreviated as BM). The safety of the explosive composition was evaluated by the mortar tests for methane and coal dust, and by the angle shot mortar test for methane.

The detonation velocity test under unconfined state was carried out in the following manner. The above obtained W/O explosive cartridge, packed in a cylindrical viscose paper tube having a diameter of 30 mm, was closed at the end by a clip. A probe was inserted into the cartridge, and the cartridge was kept at 20° C. The cartridge was initiated by means of a No. 6 electric blasting cap under unconfined state on sand, and the detonation velocity was measured by means of a digital counter.

The gap test on sand was carried out in the following manner. The above obtained cartridges, each having a diameter of 30 mm and a weight of 100 g, were kept a temperature of 5° C. and used. A donor cartridge provided with a No. 6 electric blasting cap and an acceptor cartridge were arranged on a semi-circular groove formed on sand such that both the cartridges were apart from each other by a given distance indicated by the number of multiplied times of the cartridge diameter, and the donor cartridge was initiated under confined state, and the maximum distance, under which the acceptor cartridge was able to be inductively detonated, was measured and indicated by the number of multiplied times of the cartridge diameter.

The ballistic mortar test indicates a relative strength of a sample explosive to the static strength, calculated as 100, of TNT, and was carried out according to JIS K 4810.

The safety against methane or coal dust was measured according to JIS K 4811, Test method for Safeties of 400 g permissible explosive, 600 g permissible explosive, and Eq. S-I and Eq. S-II permissible explosives. That is, 400 g (4 cartridges, each being 100 g) or 600 g (6 cartridges, each being 100 g) of sample explosive was charged into a shot-hole of a mortar, and whether methane or coal dust was inflamed or not was tested by a direct initiation of 400 g or 600 g of the explosive, wherein a No. 6 blasting cap was fitted to a cartridge arranged nearest to the inlet of the shot-hole such that the blasting cap was directed from the inlet side of the shot-hole to the bottom of the hole; or by an indirect initiation of 400 g of the explosive, wherein a No. 6 blasting cap was fitted to a cartridge arranged in the bottom of the shot-hole such that the blasting cap was directed from the bottom of the hole towards the inlet side of the hole. The safety of the explosive was indicated by the number of inflammation times of methane or coal dust based on the number of tests.

The obtained results in the above described tests are shown in Table 1.

EXAMPLES 2-6

W/O explosives were produced by using a gas-retaining agent having a particle size of not smaller than 177 μm in at least 30% volume of the agent according to the method described in Example 1, except monomethylamine nitrate, hydrazine nitrate or ethylenediamine dinitrate as a sensitizer was dissolved in aqueous solution of oxidizer salt. The resulting W/O explosives were subjected to the same tests as described in Example 1.

The obtained results are shown in Table 1.

COMPARATIVE EXAMPLE 1

A W/O explosive having the same composition as described in Example 1, except using silica balloons having a particle size of 44–177 μm (trademark: Silica Balloon SPW-7, sold by Kushiro Sekitan Kanryu Co.) as a gas-retaining agent as described in Table 1, was produced according to the method described in Example 1. The W/O emulsion was subjected to the same tests as described in Example 1.

The obtained results are shown in Table 1.

COMPARATIVE EXAMPLES 2-5

W/O explosives having a composition shown in Table 1 were produced according to the method described in Example 1 by using a gas-retaining agent having a small particle size of not larger than 177 μm, and subjected to the same tests as described in Example 1.

The obtained results are shown in Table 1.

It can be seen from the above described experiments that all the W/O explosives containing a gas-retaining agent having a particle size of not larger than 177 μm have a high detonation velocity of more than 3,000 m/sec. On the contrary, the W/O explosives of the present invention containing a gas-retaining agent having a particle size of 177–3,000 μm have a low detonation velocity of less than 3,000 μm. That is, according to the present invention, a cap-sensitive W/O explosive composition having a high sympathetic detonability and a very high safety against methane and coal dust can be obtained without deteriorating its static strength.

Among the gas-retaining agents used in the above described Examples and Comparative examples, ones shown in Table 1 are as follows.

1 GB 30–125 μm: (C-15)/250 and (B-28)/250 sold by Minnesota Mining Manufacturing Co.

2 SB 44–177 μm: NW, NL, SPW-2 and SPW-7 sold by Kushiro Sekitan Kanryu Co.

3 SB 3,000–3,500 μm: Pulverization product of a shaped board of Mitsui Perlite HP 200 sold by Mitsui Metal and Smelting Co., Ltd.

4 RB 30–74 μm: Foam Resin Balloon F-30 sold by Matsumoto Yushi Co.

5 , 6 SB 177–190 μm: NL sold by Kushiro Sekitan Kanryu Co.

7 GB 1,410–3,000 μm: Glass hollow capillaries having a length of 1,410–3,000 μm obtained by pressing and cutting glass capillaries on a cylinder by means of a pair of pincers under heating.

8 RB 1,000–3,000 μm: Hollow rectangular tetrahedrons having a dimension of 1,000–3,000 μm obtained by pressing and cutting polyethylene tubes having a diameter of about 1–1.5 mm, which had been obtained by drawing a polyethylene straw in hot water, by means of a pair of pincers heated by a flame.

These gas-retaining agents were sieved for 30 minutes by means of a sifting machine, and gas-retaining agents having a given particle size were gathered.

TABLE 1

| | | Comparative example | | | | | Example | | | | | |
|---|---|---|---|---|---|---|---|---|---|---|---|---|
| | | 1 | 2 | 3 | 4 | 5 | 1 | 2 | 3 | 4 | 5 | 6 |
| Composition (%) | | | | | | | | | | | | |
| Aqueous solution of oxidizer salt | Ammonium nitrate | 73.3 | 64.4 | 39.3 | 77.1 | 29.6 | 73.3 | 39.3 | 63.2 | 44.2 | 43.3 | 43.3 |
| | Sodium nitrate | | 9.9 | 9.4 | | 12.7 | | 9.4 | | 10.9 | 12.1 | 12.1 |
| | Calcium nitrate | | | | | | | | 10.4 | | | |
| | Sodium chlorate | 4.2 | | | | | 4.2 | | | | | |
| | Water | 12.0 | 10.9 | 6.9 | 12.2 | 8.5 | 12.0 | 6.9 | 10.9 | 8.7 | 8.0 | 8.0 |
| Sensitizer | Monomethylamine nitrate | | | 15.1 | | | | 15.1 | | | 4.3 | |
| | Hydrazine nitrate | | | | | 16.9 | | | | 5.5 | 5.5 | 9.8 |
| | Ethylenediamine dinitrate | | | | | | | | | 4.5 | | |
| Emulsifier | Sorbitan monooleate | 1.5 | 1.7 | 1.6 | | 1.3 | 1.5 | | | 1.5 | 1.5 | 1.5 |
| | Sorbitan sesquioleate | | | | 1.5 | | | 1.0 | 1.7 | | | |
| | Stearic acid monoglyceride | | | | | | | 0.6 | | | | |
| Carbonaceous fuel | No. 2 gas oil | | | 1.2 | | | | 1.2 | 3.1 | | | |
| | Crude paraffin wax | 3.0 | 3.4 | 2.0 | 3.0 | 2.5 | 3.0 | 2.0 | | 2.9 | 2.9 | 2.9 |
| Other components | Sodium chloride | | 9.3 | 20.9 | | 23.2 | | 20.9 | 5.0 | 19.0 | 22.1 | 22.0 |
| Gas-retaining agent | 1 GB 30–125 μm | | | 3.6 | | | | | | | | |
| | 2 SB 44–177 μm | 6.0 | | | | 5.3 | | 2.1 | | | | |
| | 3 SB 3,000–5,000 μm | | | | 6.2 | | | | | | | |
| | 4 RB 30–74 μm | | 0.4 | | | | | | | | | |

TABLE 1-continued

| | | | Comparative example | | | | | Example | | | | | |
|---|---|---|---|---|---|---|---|---|---|---|---|---|---|
| | | | 1 | 2 | 3 | 4 | 5 | 1 | 2 | 3 | 4 | 5 | 6 |
| 5 SB 177-350 μm | | | | | | | | | 0.4 | | | | |
| 6 SB 210-1,190 μm | | | | | | | | 5.0 | | 5.6 | 1.4 | | 0.2 |
| 7 GB 1,500-3,000 μm | | | | | | | | 1.0 | | | | | |
| 8 RB 1,000-3,000 μm | | | | | | | | | 0.5 | | 1.4 | 0.3 | 0.2 |
| Performance | | | | | | | | | | | | | |
| Density (g/cc) | | | 1.10 | 1.15 | 1.16 | 1.15 | 1.20 | 1.11 | 1.10 | 1.14 | 1.25 | 1.27 | 1.24 |
| Detonation velocity under unconfined state (20° C.) (m/sec) | | | 4,200 | 5,100 | 3,630 | not detonated | 4,040 | 2,670 | 2,720 | 2,700 | 2,420 | 2,350 | 2,300 |
| Sympathetic detonability on sand (5° C.) (times) | | | 1.5 | 1.0 | 0.3 | — | 1.5 | 3.0 | 2.0 | 2.0 | 2.5 | 2.5 | 3 |
| BM | | | 99 | 93 | 66 | 105 | 71 | 100 | 68 | 88 | 75 | 72 | 75 |
| Safety against methane | | | | | | | | | | | | | |
| Mortar test | Direct initiation: | 400 g | 0/5 | 2/5 | | — | | 0/5 | | | | | |
| | Direct initiation: | 600 g | 1/3 | | | — | | 0/5 | | 0/5 | | | |
| | Indirect initiation: | 400 g | 2/2 | | 1/3 | — | 1/2 | 1/5 | 0/5 | 0/5 | 0/5 | | |
| Angle shot mortar test | | 100 g | | | 2/3 | | 1/1 | 1/3 | 0/5 | 1/3 | | | |
| | | 200 g | | | | | | | 1/5 | | 0/5 | 0/5 | 0/5 |
| | | 300 g | | | | | | | | | 1/1 | 1/5 | 0/5 |
| Safety against coal dust | | | | | | | | | | | | | |
| Mortar test | Indirect initiation: | 400 g | 1/3 | 1/3 | | | | 0/5 | 0/5 | 0/5 | 0/5 | 0/5 | 0/5 |

We claim:

1. A water-in-oil emulsion explosive composition comprising:

a continuous phase consisting of a carbonaceous fuel component;

a disperse phase consisting of an aqueous solution of inorganic oxidizer salt; and an emulsifier and a gas-retaining agent, wherein at least 30% by volume of said gas-retaining agent has a particle size of 600-3,000 μm.

2. A water-in-oil emulsion explosive composition according to claim 1 further comprising at least one sensitizer selected from the group consisting of monomethylamine nitrate, hydrazine nitrate ethanolamine nitrate, ethylenediamine dinitrate, urea nitrate, trinitrotoluene, aluminum powder, quanidine nitrate and glycinonitrile.

3. A water-in-oil emulsion explosive composition according to claim 1, further comprising at least one flame coolant selected from the group consisting of sodium chloride and potassium chloride.

4. A water-in-oil emulsion explosive composition according to claim 1, wherein at least 50% by volume of said gas-retaining agent has a particle size of 600-2,000 μm.

* * * * *